US008562127B2

(12) United States Patent
Haneda

(10) Patent No.: US 8,562,127 B2
(45) Date of Patent: Oct. 22, 2013

(54) RECORDING METHOD

(75) Inventor: Yuya Haneda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 257 days.

(21) Appl. No.: 12/976,416

(22) Filed: Dec. 22, 2010

(65) Prior Publication Data

US 2011/0157284 A1 Jun. 30, 2011

(30) Foreign Application Priority Data

Dec. 28, 2009 (JP) ..... 2009-297052

(51) Int. Cl.
*B41J 2/01* (2006.01)

(52) U.S. Cl.
USPC ..... 347/102

(58) Field of Classification Search
USPC ..... 347/102
See application file for complete search history.

(56) References Cited

U.S. PATENT DOCUMENTS 5,554,413 A * 9/1996 Nikaido et al. ..... 427/108
6,312,123 B1 11/2001 Codos et al.
8,007,577 B2 * 8/2011 Gotoh ..... 106/31.6

FOREIGN PATENT DOCUMENTS

JP 11-274335 A 10/1999

* cited by examiner

*Primary Examiner* — Omar Rojas
(74) *Attorney, Agent, or Firm* — Global IP Counselors, LLP

(57) ABSTRACT

A recording method includes: printing a recording pattern onto an electronic component with a photocuring liquid having the property of accelerating curing when irradiated with light; irradiating light onto liquid that constitutes the recording pattern after the printing of the recording pattern; and thinning the film that constitutes the recording pattern after the irradiating of the light.

7 Claims, 6 Drawing Sheets

RECORDING METHOD

CROSS-REFERENCE TO RELATED APPLICATIONS

This application claims priority to Japanese Patent Application No. 2009-297052 filed on Dec. 28, 2009. The entire disclosure of Japanese Patent Application No. 2009-297052 is hereby incorporated herein by reference.

BACKGROUND

1. Technical Field

The present invention relates to a recording method.

2. Related Art

Recording of recording patterns, such as lot indicators, product numbers, and the like, on electronic product packages is widely practiced.

In the field of such recording, methods of producing (recording) markings (recording patterns) with inks that contain an ultraviolet curing resin are known (see Japanese Laid-Open Patent Application 11-274335, for example).

SUMMARY

According to the marking method (recording method) disclosed in the aforementioned Japanese Laid-Open Patent Application 11-274335, packages which have been marked are irradiated with ultraviolet light in order to cure the ink. By so doing, it is easy to maintain markings on materials that have minimal receptivity of ink (ability to absorb ink).

In the field of electronic components, cleaning processes are sometimes carried out while the components are mounted on a circuit board or the like. In such cleaning processes, it is typical to use solvents and the like as detergents. However, when packages that have undergone marking by the marking method discussed above are subjected to cleaning, markings can sometimes become swelled by solvents. If a marking swells, stress is created in the film constituting the marking, creating a susceptibility to delaminate from the package.

Specifically, a problem encountered with prior art recording methods is the difficulty of improving the dependability of recording patterns.

The present invention is intended to address the aforementioned problems at least in part according to the following modes and aspects.

A recording method according to a first aspect of the present invention includes printing a recording pattern onto an electronic component with a photocuring liquid having the property of accelerating curing when irradiated with light; irradiating light onto liquid that constitutes the recording pattern after the printing of the recording pattern; and thinning the film that constitutes the recording pattern after the irradiating of the light.

The recording method according to the present aspect includes a printing step, a photoirradiation step, and a thinning step. In the printing step, a recording pattern is patterned onto an electronic component with a photocuring liquid. Photocuring refers to the property of accelerating curing when irradiated with light.

Subsequent to the printing step, in the photoirradiation step, the liquid that constitutes the recording pattern is irradiated with light. Curing of the liquid that constitutes the recording pattern is accelerated thereby. As a result, a film constituting the recording pattern is formed.

Subsequent to the photoirradiation step, in the thinning step, the film that constitutes the recording pattern is thinned.

Through the above, the recording pattern may be reduced in volume. As a result, the extent of swelling of the recording pattern by liquids such as solvents is reduced, as compared with prior to thinning of the film constituting the recording pattern. Therefore, stress arising in the film making up the recording pattern may easily be reduced, and the recording pattern may be made resistant to delamination from the electronic component. Consequently, improvement of dependability of the recording patterns may be readily achieved.

In the aforementioned recording method, the thinning of the film preferably includes thinning the film by heating the recording pattern.

According to this aspect, in the thinning step, the film is thinned by heating of the recording pattern, thereby readily preventing external forces from acting on the film.

In the aforementioned recording method, in the irradiating of the light, polymerization of the liquid is preferably kept at a rate of 70% or less.

According to this aspect, in the photoirradiation step, polymerization of the liquid is kept to 70% or less. Consequently, improvement of dependability of the recording patterns may be readily achieved.

In the aforementioned recording method, in the irradiating of the light, polymerization of the liquid is preferably kept at a rate of 40% or less.

According to this aspect, in the photoirradiation step, polymerization of the liquid is kept to 40% or less. Consequently, further improvement of dependability of the recording patterns may be readily achieved.

In the aforementioned recording method, the liquid is preferably ejected onto the electronic component by an inkjet method in the printing of the recording pattern, thereby printing the recording pattern onto the electronic component.

According to this aspect, in the printing step, the recording pattern is printed onto the electronic component through ejection of liquid by an inkjet method. According to this recording method, because the recording pattern is printed onto the electronic component through ejection of liquid by an inkjet method, it is easy to apply any desired amount of liquid at any desired site on the electronic component.

The aforementioned recording method preferably further includes accelerating curing of the film constituting the recording pattern after the thinning of the film.

According to this aspect, the method has a curing step performed after the thinning step, for accelerating curing of the film that constitutes the recording pattern, and therefore the film that constitutes the recording pattern may readily be made stronger. By so doing, the recording pattern may be made even more resistant to delamination from the electronic component, and therefore further improvement of dependability of the recording patterns may be readily achieved.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
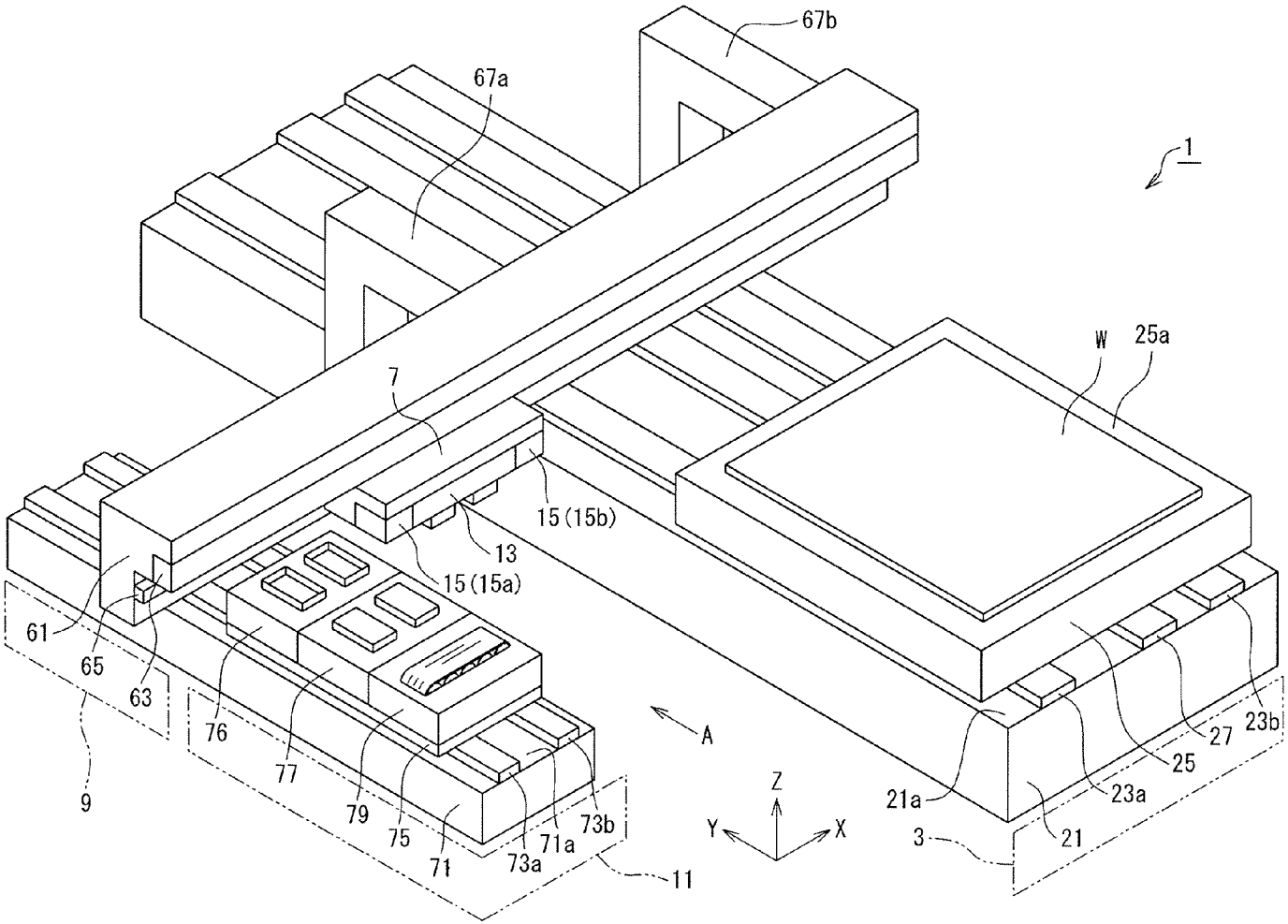
FIG. 1 is a perspective view depicting a simplified configuration of a droplet ejection device in the embodiment.

The following description of the embodiments makes reference to the accompanying drawings. In the drawings, the scale of features and components may differ from actual ones, in order to depict the respective features with size sufficient to be recognizable.

As shown in a simplified configuration perspective view in FIG. 1, the droplet ejection device 1 of the present embodiment has a workpiece conveyor device 3, a carriage 7, a carriage conveyor device 9, and a maintenance device 11.

The carriage 7 is provided with a head unit 13 and with two irradiation devices 15.

In the droplet ejection device 1, a liquid is ejected in droplets from the head unit 13 while varying the relative positions in plan view of the head unit 13 and a workpiece W such as a substrate, whereby a desired pattern may be printed onto the workpiece W with the liquid. The Y direction in the drawing indicates the travel direction of the workpiece W, while the X direction indicates the direction orthogonal to the Y direction in plan view. The direction orthogonal to the XY plane defined by the X direction and the Y direction is defined as the Z direction.

This kind of droplet ejection device 1 is adaptable for the manufacture of color filters used in liquid crystal display panels or the like, or for the manufacture of organic EL devices, for example.

In the case of a color filter having filter elements of the three colors red, green, and blue, the droplet ejection device 1 is favorable for use in the steps to form the red, green, and blue color layers on the substrate. In this case, liquids corresponding to the individual color layers are ejected in droplet form onto the workpiece W from the head unit 13, thereby printing a pattern of respective red, green, and blue filter elements onto the workpiece W.

In the case of manufacture of an organic EL device, the ejection device is favorable for use in the steps of forming the functional layers (organic layer) corresponding to red, green, and blue, for the colors of each individual pixel, for example. In this case, liquids corresponding to the functional layers of each color are ejected in droplet form onto the workpiece W from the head unit 13, thereby printing a pattern of respective red, green, and blue functional layers onto the workpiece W.

Following is a detailed description of the features of the droplet ejection device 1.

As shown in FIG. 1, the workpiece conveyor device 3 has a platen 21, a guide rail 23*a*, a guide rail 23*b*, a workpiece table 25, and a table position detection device 27.

The platen 21 is composed of a material having a low coefficient of thermal expansion such as stone, for example, and is installed so as to extend along the Y direction. The guide rail 23*a* and the guide rail 23*b* are disposed on the upper face 21*a* of the platen 21. The guide rail 23*a* and the guide rail 23*b* respectively extend along the Y direction. The guide rail 23*a* and the guide rail 23*b* line up with a gap between them in the X direction.

The workpiece table 25 is disposed facing the upper face 21*a* of the platen 21, with the guide rail 23*a* and the guide rail 23*b* therebetween. The workpiece table 25 rests on the guide rail 23*a* and the guide rail 23*b* in a condition suspended above the platen 21. The workpiece table 25 has a resting face which is the face on which the workpiece W rests. The resting face 25*a* faces towards the opposite side from the platen 21 side (the upper side). The workpiece table 25 is designed to be capable of reciprocating movement along the Y direction over the platen 21 while guided along the Y direction by the guide rail 23*a* and the guide rail 23*b*.

The table position detection device 27 is disposed on the upper face 21*a* of the platen 21 and extends in the Y direction. The table position detection device 27 is disposed between the guide rail 23*a* and the guide rail 23*b*. The table position detection device 27 detects the position of the worktable 25 in the Y direction.

The worktable 25 is designed to be capable of reciprocating movement in the Y direction by a movement mechanism and a power source, not shown. As movement mechanisms there may be employed, for example, a mechanism that is a combination of a ball screw and a ball nut, a linear guide mechanism, or the like. In the present embodiment, a workpiece conveyor motor, discussed later, is employed as the power source for moving the workpiece table 25 along the Y direction. Various types of motors may be employed as workpiece conveyor motors, such as a stepping motor, a servo motor, a linear motor, or the like.

Power from the workpiece conveyor motor is transmitted to the workpiece table 25 via the movement mechanism. The workpiece table 25 is thereby able to undergo reciprocating movement along the guide rail 23*a* and the guide rail 23*b*, i.e., along the Y direction. Specifically, the workpiece conveyor device 3 can bring about reciprocating movement along the Y direction, of the workpiece W resting on the resting face 25*a* of the worktable 25.

Figure 2:
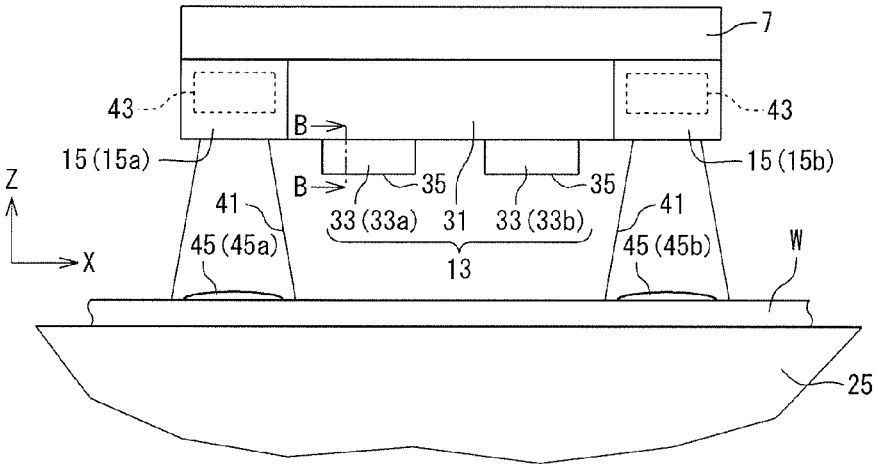
FIG. 2 is a front view of a carriage in the embodiment, seen in front view along direction A in FIG. 1.

As shown in FIG. 2, which is a front view of the carriage 7 viewed in direction A in FIG. 1, the head unit 13 has a head plate 31 and two ejection heads 33. The two ejection heads 33 line up in the X direction. The number of ejection heads 33 is not limited to two, and any number of one or more may be employed. Hereinbelow, when respectively distinguishing between the two ejection heads 33, the designations of ejection head 33*a* and ejection head 33*b* are used.

Figure 3:
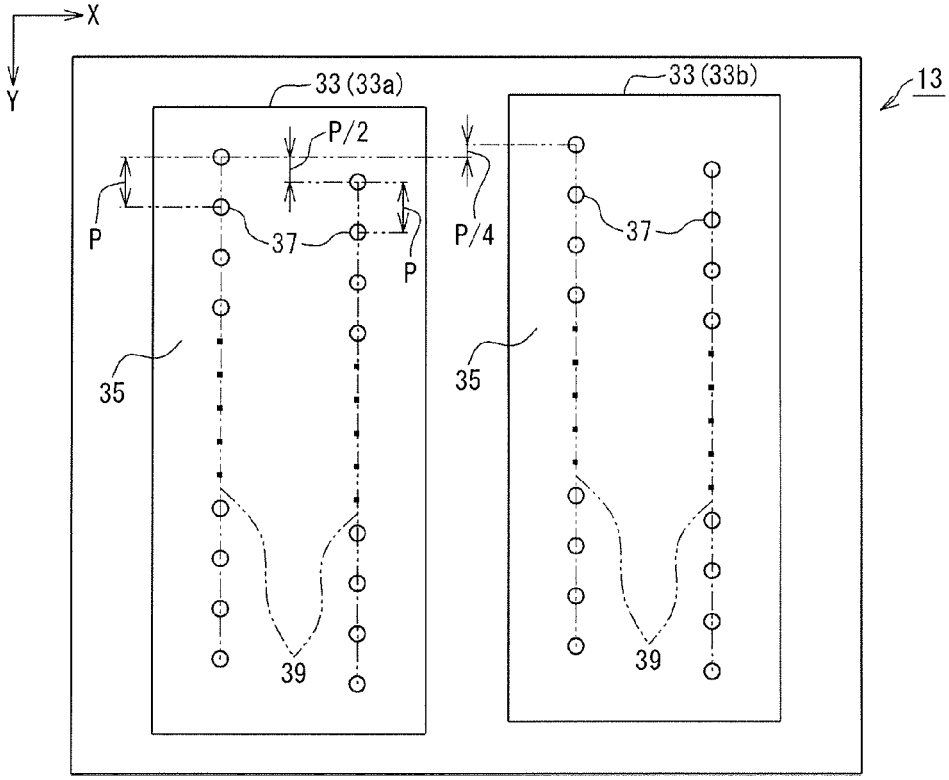
FIG. 3 is a bottom view of a head unit in the embodiment.

As shown in bottom view in FIG. 3, the ejection heads 33 have nozzle faces 35. A plurality of nozzles 37 are formed in the nozzle faces 35. In FIG. 3, the nozzles 37 are shown exaggerated in size and a smaller number of nozzles 37 are shown, in order to show the nozzles 37 more clearly.

In each of the ejection heads 33, the plurality of nozzles 37 arrayed along the Y direction to constitute two nozzle rows 39. The two nozzle rows 39 line up spaced apart from one another by a gap in the X direction. In each nozzle row 39, the plurality of nozzles 37 are formed at a prescribed nozzle spacing P along the Y direction. In each of the ejection heads 33, the two nozzle rows 39 are shifted with respect to one another in the Y direction by a distance equivalent to P/2.

In the head unit 13, the nozzle rows 39 of one of the two ejection heads 33 and the nozzle rows 39 of the other ejection head 33 are shifted with respect to one another in the Y direction by a distance equivalent to P/4. Therefore, in the present embodiment, the density of the nozzles 37 in the Y direction is higher.

As shown in FIG. 2, the two irradiation devices 15 are respectively disposed at facing locations to either side of the head unit 13 in the X direction. Hereinbelow, when respectively distinguishing between the two irradiation devices 15, the designations of irradiation device 15*a* and irradiation device 15*b* are used.

The irradiation device 15*a* is positioned to the opposite side of the ejection head 33*a* from the ejection head 33*b* side in the X direction. The irradiation device 15*b* is positioned to the opposite side of the ejection head 33*b* from the ejection head 33*a* side in the X direction.

The irradiation device 15*a* and the irradiation device 15*b* respectively have a light source 43 that emits ultraviolet light 41. The ultraviolet light 41 emitted from the light source 43 accelerates curing of a liquid 45 that has been ejected from the ejection heads 33. The liquid 45 experiences accelerated curing when exposed to irradiation with the ultraviolet light. As the light source 43, any of various light sources 43 such as an LED, LD, mercury lamp, metal halide lamp, xenon lamp, excimer lamp, or the like may be employed, for example.

Figure 4:
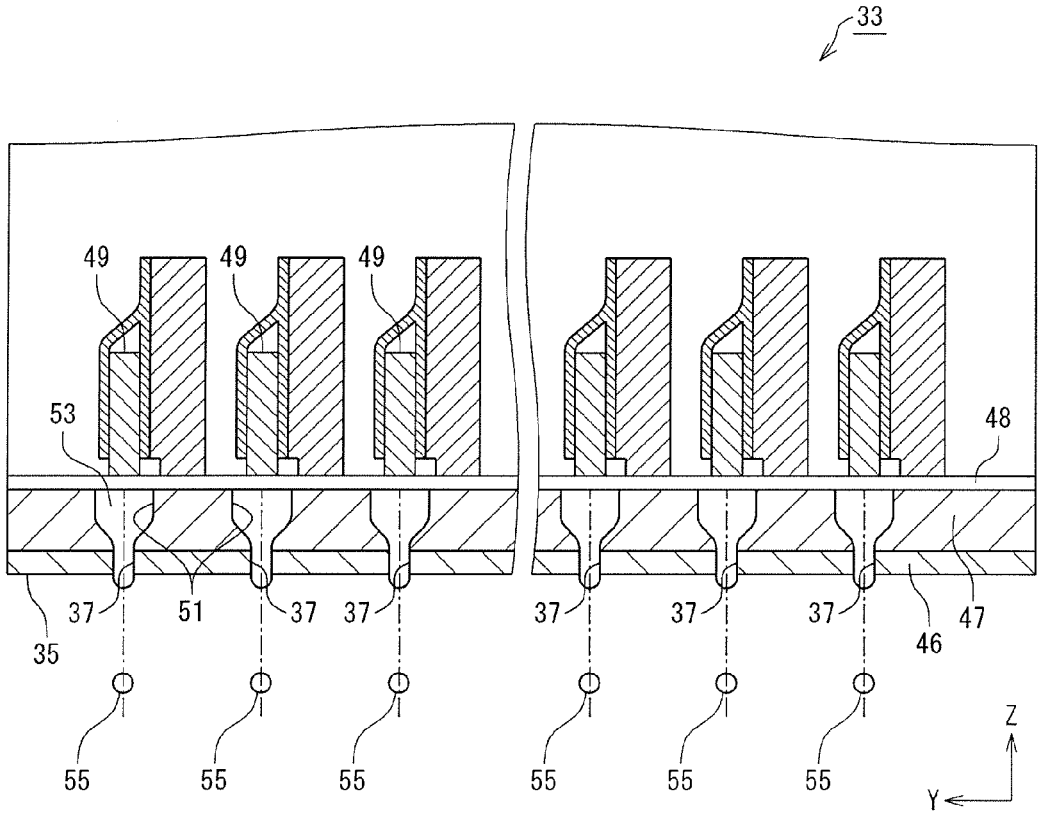
FIG. 4 is a cross-sectional view taken along line B-B in FIG. 2.

As shown in FIG. 4, which is a cross-sectional view taken along line B-B in FIG. 2, the ejection head 33 has a nozzle plate 46, a cavity plate 47, a vibrating plate 48, and a plurality of piezoelectric elements 49.

The nozzle plate 46 has a nozzle face 35. A plurality of nozzles 37 are provided to the nozzle plate 46.

The cavity plate 47 is disposed on the face of the nozzle plate 46 on the opposite side from the nozzle face 35. A plurality of cavities 51 are formed in the cavity plate 47. The cavities 51 are provided in correspondence with the nozzles 37, and communicate with the corresponding nozzles 37. The cavities 51 are supplied with a functional fluid 53 from a tank, not shown.

The vibrating plate 48 is disposed on the cavity plate 47, on the face thereof lying on the opposite side from the nozzle plate 46. The vibrating plate 48 expands and contracts the volume inside the cavities 51 by vibrating in the Z direction (vertical vibration).

The plurality of piezoelectric elements 49 are respectively disposed on the vibrating plate 48 on the face thereof lying on the opposite side from the cavity plate 47. The piezoelectric elements 49 are disposed in correspondence with the cavities 51, and are situated in opposition to the cavities 51 with the vibrating plate 48 therebetween. The piezoelectric elements 49 undergo extension on the basis of drive signal. The vibrating plate 48 thereby contracts the volume inside the cavities 51. At this time, pressure is imparted to the functional fluid 53 inside the cavities 51. As a result, the functional fluid 53 is ejected as droplets 55 from the nozzles 37. The method of ejection of droplets 55 by the ejection heads 33 is one inkjet method. The inkjet method is one application method.

As shown in FIG. 2, the ejection heads 33 having the above configuration are supported on the head plate 31, with the nozzle faces 35 protruding out from the head plate 31.

As shown in FIG. 2, the carriage 7 supports the head unit 13. Here, the head unit 13 is supported on the carriage 7, with the nozzle faces 35 facing downward in the Z direction.

In the present embodiment, piezoelectric elements 49 of vertically oscillating type are employed; however, the pressurizing means for imparting pressure to the functional fluid 53 are not limited thereto, and there may instead be employed, for example, piezoelectric elements of flexurally deforming type composed of a stacked lower electrode, piezoelectric layer, and upper electrode. As pressurizing means there may also be employed a so-called electrostatic actuator which generates static electricity between a vibrating plate and an electrode, whereby deformation of the vibrating plate by electrostatic force causes droplets to be ejected from the nozzles. There may also be employed an arrangement in which bubbles are produced inside the nozzles by a heating element and pressure is imparted to the functional fluid by the bubbles.

In the present embodiment, a liquid 45 that experiences accelerated curing when irradiated with light is employed as the functional fluid 53. In the present embodiment, ultraviolet light 41 (FIG. 2) is employed as the light for accelerating curing of the liquid 45.

The liquid 45 includes as components a resin material, a photopolymerization initiator, and a solvent. Optionally, coloring matter such as pigments, dyes, and the like, or functional materials such as surface modifying materials for lyophilicity, liquid repellence, or the like, may be added to these components to produce a liquid 45 having unique functionality. A liquid 45 containing coloring matter such as pigments, dyes, and the like may be employed as the image-forming functional fluid 53 for printing onto the workpiece W, for example. Hereinbelow, an image-forming functional fluid 53 for printing onto the workpiece W is termed an image coating compound.

By employing as the resin material component of the liquid 45 a resin material having light transmittance, such as an acrylic resin material, for example, there may be provided a functional fluid 53 having light transmittance. Applications as a clear ink, for example, may be contemplated for such a functional fluid 53 having light transmittance. Hereinbelow, a functional fluid 53 having light transmittance is termed a transmissive coating compound.

Applications as an overcoat layer for covering an image, applications as a foundation layer prior to forming an image, and the like may be contemplated as clear ink applications, for example. Hereinbelow, a functional fluid 53 for application as a foundation layer is termed a foundation coating compound.

Foundation coating compounds are not limited to transmissive coating compounds, and functional fluids 53 containing various pigments added to transmissive coating compounds may be employed also.

The resin material in the liquid 45 is a material for forming a resin film. No particular limitations are imposed as to the resin material, provided that the material is liquid at normal temperature, and forms a polymer through polymerization. In preferred practice the resin material has low viscosity, and preferably takes the form of an oligomer. Still more preferably, the resin material takes the form of a monomer.

The photopolymerization initiator is an adjuvant for acting on crosslinking groups of the polymer to accelerate crosslinking reactions. Benzyl dimethyl ketal or the like may be employed as a photopolymerization initiator, for example.

The solvent is used to adjust the viscosity of the resin material.

As shown in FIG. 1, the carriage conveyor device 9 has a mount 61, a guide rail 63, and a carriage position detection device 65.

The mount 61 extends in the X direction, and spans the workpiece conveyor device 3 and the maintenance device 11 in the X direction. The mount 61 is disposed in opposition to the workpiece conveyor device 3 and the maintenance device 11, respectively, to the opposite side of the workpiece table 25 from the platen 21. The mount 61 supports a support post 67*a* and a support post 67*b*. The support post 67*a* and the support post 67*b* are disposed at locations facing one another in the X direction with the platen 21 between them. The support post 67*a* and the support post 67*b* respectively protrude upward in the Z direction from the workpiece table 25. Gaps are thereby produced between the mount 61 and the workpiece table 25, and between the mount 61 and the maintenance device 11, respectively.

The guide rail 63 is disposed on the platen 21 side of the mount 61. The guide rail 63 extends along the X direction, and is disposed along the entire width of the mount 61 in the X direction. The aforementioned carriage 7 is supported by the guide rail 63. With the carriage 7 supported by the guide rail 63, the nozzle faces 35 of the ejection heads 33 face towards the workpiece table 25 in the Z direction. The carriage 7 is guided along the X direction by the guide rail 63 and supported by the guide rail 63 such that reciprocating movement in the X direction is possible. In plan view, with the carriage 7 overlapping the workpiece table 25, the nozzle faces 35 and the resting face 25*a* of the workpiece table 25 face towards one another, and with a gap maintained between them.

The carriage position detection device 65 is disposed between the mount 61 and the carriage 7, and extends in the X direction. The carriage position detection device 65 detects the position of the carriage 7 in the X direction.

The carriage 7 is designed to be capable of reciprocating movement in the X direction by a movement mechanism and a power source, not shown. As movement mechanisms there may be employed, for example, a mechanism that is a combination of a ball screw and a ball nut, a linear guide mechanism, or the like. In the present embodiment, a carriage conveyor motor, discussed later, is employed as the power source for moving the carriage 7 along the X direction. Various types of motors may be employed as carriage conveyor motors, such as a stepping motor, a servo motor, a linear motor, or the like.

Power from the carriage conveyor motor is transmitted to the carriage 7 via the movement mechanism. The carriage 7 is thereby able to undergo reciprocating movement along the guide rail 63, i.e., along the X direction. Specifically, the carriage conveyor device 9 can bring about reciprocating movement along the X direction, of the head unit 13 which is supported on the carriage 7.

As shown in FIG. 1, the maintenance device 11 has a platen 71, a guide rail 73*a*, a guide rail 73*b*, a maintenance table 75, a capping unit 76, a flushing unit 77, and a wiping unit 79.

The platen 71 is composed of a material having a low coefficient of thermal expansion such as stone, for example, and is disposed at a location facing the platen 21 in the X direction, with the support post 67*a* therebetween.

The guide rail 73*a* and the guide rail 73*b* are disposed on the upper face 71*a* of the platen 71. The guide rail 73*a* and the guide rail 73*b* respectively extend along the Y direction. The guide rail 73*a* and the guide rail 73*b* line up with a gap between them in the X direction.

The maintenance table 75 is disposed facing the upper face 71*a* of the platen 71, with the guide rail 73*a* and the guide rail 73*b* therebetween. The maintenance table 75 rests on the guide rail 73*a* and the guide rail 73*b* in a condition suspended above the platen 71.

Maintenance units, such as the capping unit 76, the flushing unit 77, and the wiping unit 79, rest on the maintenance table 75. In the present embodiment, the maintenance units include the capping unit 76, the flushing unit 77, and the wiping unit 79.

The maintenance table 75 is designed to be capable of reciprocating movement along the Y direction over the platen 71 while guided along the Y direction by the guide rail 73*a* and the guide rail 73*b*.

The flushing unit 77 is disposed on the maintenance table 75 on the opposite side thereof from the platen 71.

Here, an operation of ejecting liquid from the ejection heads 33 is termed a flushing operation, irrespective of whether a pattern is printed on the workpiece W. Flushing operations are effective in preventing liquid that collects inside the nozzles 37 from hardening inside the nozzles 37, for example. The flushing unit 77 is a device for receiving liquid ejected from the ejection heads 33 during flushing operations.

The capping unit 76 is a device for placing a cap over the ejection heads 33. When liquid is ejected from the ejection heads 33, there is some evaporation of the liquid component. Typically, with evaporation of the liquid component in a liquid, the viscosity of the liquid increases. If the viscosity of the liquid inside the ejection heads 33 increases, the ability to eject droplets 55 in the nozzles 37 (hereinafter termed ejection ability) may be diminished. Diminished ejection ability may be manifested, for example, as crooked direction of advance (crooked trajectory) of droplets 55 ejected from the nozzles 37, inability to eject droplets 55 from the nozzles 37 (ejection failure), or the like. An operation of placing a cap on the ejection heads 33 by the capping unit 76 is termed a capping operation.

By placing a cap on the ejection heads 33, the capping unit 76 keeps evaporation of the liquid component in the liquid from the nozzles to a low level. It is therefore easy to maintain the ejection ability of the ejection heads 33.

The wiping unit 79 is a device for wiping the nozzle faces 35 of the ejection heads 33. In the droplet ejection device 1, liquid sometimes adheres to the nozzle faces 35. When liquid adheres to the nozzle faces 35, the ejection capability of the ejection heads 33 may be diminished. By wiping the nozzle faces 35, the wiping unit 79 wipes away the liquid adhering to the nozzle faces 35. It is therefore easy to maintain the ejection ability of the ejection heads 33. An operation of wiping the nozzle faces 35 by the wiping unit 79 is termed a wiping operation.

The maintenance table 75 is designed to be capable of reciprocating movement in the Y direction by a movement mechanism and a power source, not shown. As movement mechanisms there may be employed, for example, a mechanism that is a combination of a ball screw and a ball nut, a linear guide mechanism, or the like. In the present embodiment, a table conveyor motor, discussed later, is employed as the power source for moving the maintenance table 75 along the Y direction. Various types of motors may be employed as table conveyor motors, such as a stepping motor, a servo motor, a linear motor, or the like.

Power from the table conveyor motor is transmitted to the maintenance table 75 via the movement mechanism. The maintenance table 75 is thereby able to undergo reciprocating movement along the guide rail 73*a* and the guide rail 73*b*, i.e., along the Y direction.

Specifically, the maintenance device 11 can bring about reciprocating movement along the Y direction, of the maintenance units such as the capping unit 76, the flushing unit 77, and the wiping unit 79. With the maintenance device 11 overlapping the ejection heads 33 in plan view, the ejection heads 33 may thereby be positioned respectively facing the capping unit 76, the flushing unit 77, and the wiping unit 79.

Figure 5:
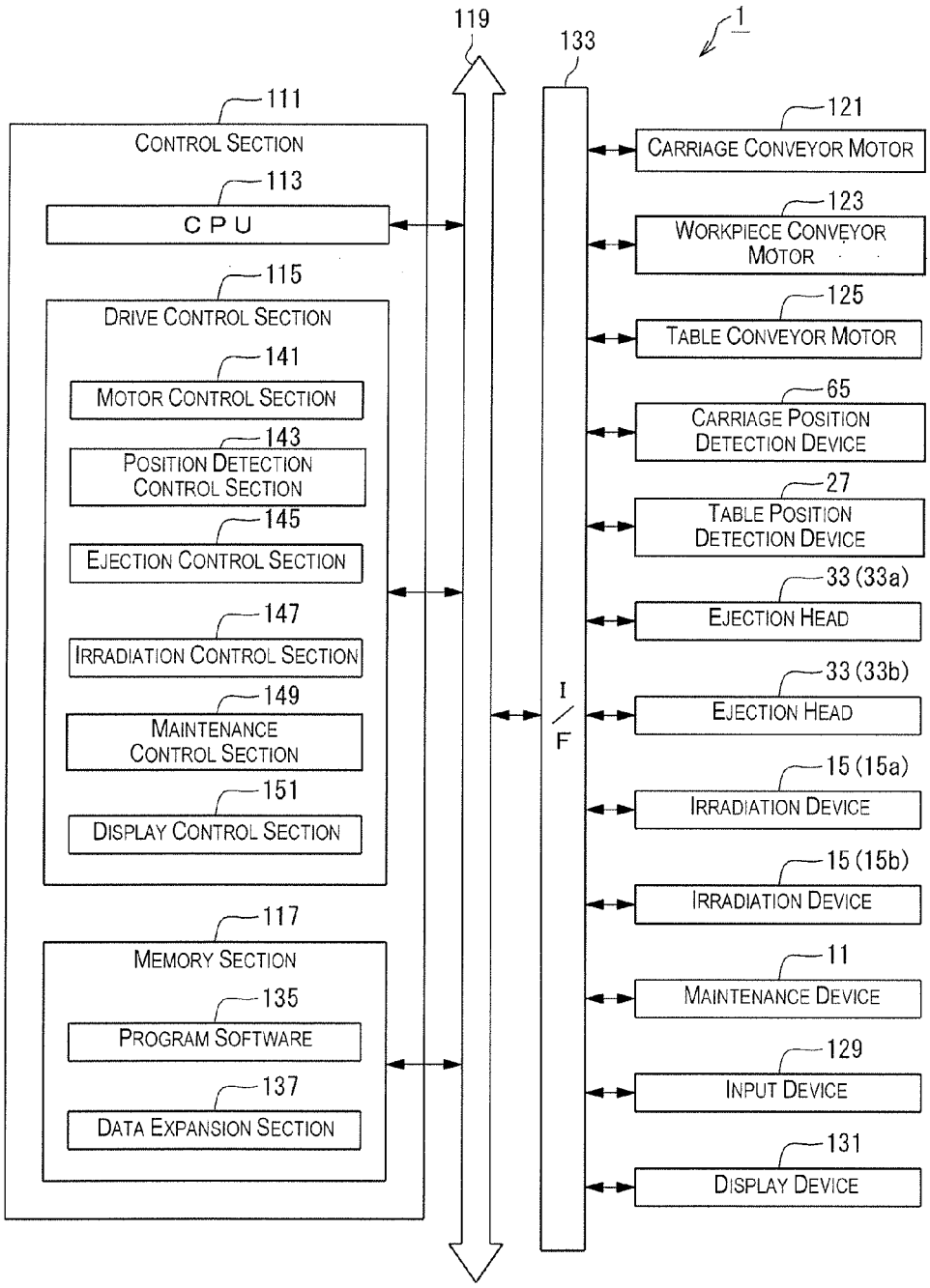
FIG. 5 is a lock diagram depicting a simplified configuration of the droplet ejection device in the embodiment.

As shown in FIG. 5, the droplet ejection device 1 has a control section 111 for controlling operations of the aforementioned features. The control section 111 has a CPU (Central Processing Unit) 113, a drive control section 115, and a memory section 117. The drive control section 115 and the memory section 117 are connected to the CPU 113 via a bus 119.

The droplet ejection device 1 also has a carriage conveyor motor 121, a workpiece conveyor motor 123, a table conveyor motor 125, and input device 129, and a display device 131.

The carriage conveyor motor 121, the workpiece conveyor motor 123, and the table conveyor motor 125 are respectively connected to the control section 111 via an input/output interface 133 and a bus 119. Likewise, the input device 129 and the display device 131 are respectively connected to the control section 111 via the input/output interface 133 and the bus 119.

The carriage conveyor motor 121 generates power for driving the carriage 7. The workpiece conveyor motor 123 generates power for driving the workpiece table 25. The table conveyor motor 125 generates power for driving the maintenance table 75. The input device 129 is a device for input of various process parameters. The display device 131 is a device for displaying process parameters and operation status. The human operator controlling the droplet ejection device 1 inputs information of various kinds via the input device 129, while verifying information displayed on the display device 131.

The carriage position detection device 65, the table position detection device 27, and the two ejection heads 33 are respectively connected to the control section 111 via the input/output interface 133 and the bus 119. The two irradiation devices 15 and the maintenance device 11 are also connected to the control section 111 via the input/output interface 133 and the bus 119.

The CPU 113 carries out various computational processes as a processor. The drive control section 115 controls driving of various features. The memory section 117 includes a RAM (Random Access Memory), a ROM (Read-Only Memory), and the like. An area for storing program software 135 that describes control processes of operations in the droplet ejection device 1 and a data expansion section 137 which is an area for temporary expansion of various kinds of data are set up in the memory section 117. Examples of data for expansion to the data expansion section 137 may include print data indicating a pattern for printing, program data such as a printing process, and the like.

The drive control section 115 has a motor control section 141, a position detection control section 143, an ejection control section 145, an irradiation control section 147, a maintenance control section 149, and a display control section 151.

On the basis of instructions from the CPU 113, the motor control section 141 individually controls driving of the carriage conveyor motor 121, driving of the workpiece conveyor motor 123, and driving of the table conveyor motor 125.

On the basis of instructions from the CPU 113, the position detection control section 143 individually controls the carriage position detection device 65 and the table position detection device 27.

On the basis of instructions from the CPU 113, the position detection control section 143 detects the position of the carriage 7 in the X direction with the carriage position detection device 65, and outputs the detection result to the CPU 113.

On the basis of instructions from the CPU 113, the position detection control section 143 detects the position of the workpiece table 25 in the Y direction with the table position detection device 27, and outputs the detection result to the CPU 113.

On the basis of instructions from the CPU 113, the ejection control section 145 individually controls driving of the two ejection heads 33.

On the basis of instructions from the CPU 113, the irradiation control section 147 individually controls light emission by the respective light sources 43 of the irradiation device 15*a* and the irradiation device 15*b*.

On the basis of instructions from the CPU 113, the maintenance control section 149 individually controls driving of the maintenance units in the maintenance device 11, such as the capping unit 76, the flushing unit 77, and the wiping unit 79.

On the basis of instructions from the CPU 113, the display control section 151 controls driving of the display device 131.

The description here turns to the printing process in the droplet ejection device 1.

Figure 6:
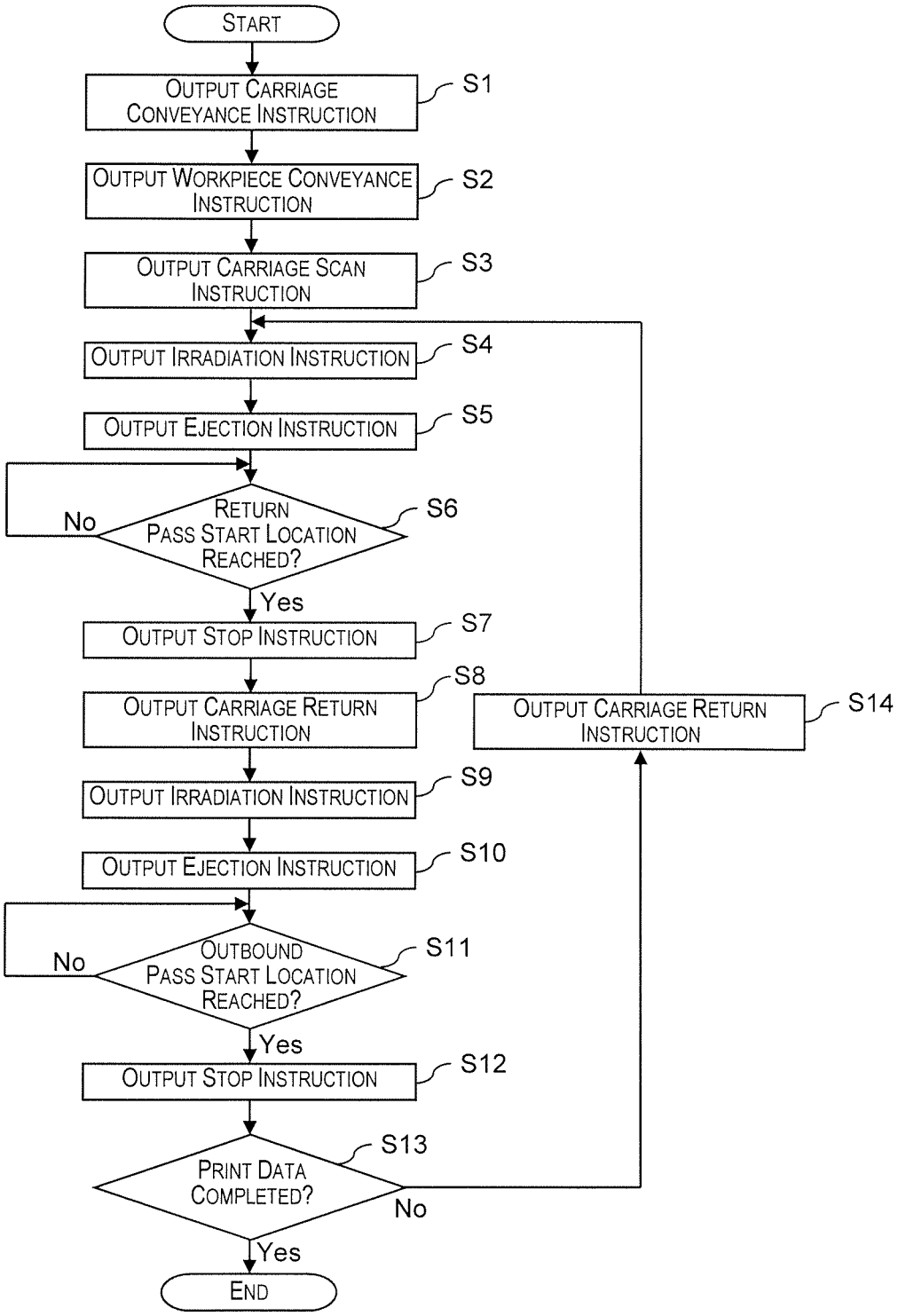
FIG. 6 is a diagram depicting the flow of the printing process in the embodiment.

In the droplet ejection device 1, the printing process depicted in FIG. 6 is initiated by the CPU 113 when the control section 111 receives print data from the input device 129 via the input/output interface 133 and the bus 119.

Here, the print data indicates a pattern to be printed on the workpiece W with the functional fluid 53 (liquid), and represents in bitmap form the pattern that is to be printed. Printing of the pattern on the workpiece W is carried out with the ejection heads 33 facing towards the workpiece W, through ejection of droplets 55 from the ejection heads 33 according to a prescribed cycle, while bringing about relative reciprocating movement of the ejection heads 33 and the workpiece W.

In the printing process, first, in Step S1, the CPU 113 outputs a carriage conveyance instruction to the motor control section 141 (FIG. 5). At this time, the motor control section 141 controls driving of the carriage conveyor motor 121 to move the carriage 7 to an outbound pass start location in the printing area. Here, the printing area is an area of overlap between the trajectory described along the Y direction by the workpiece table 25 shown in FIG. 1 and the trajectory described along the X direction by the two ejection heads 33. The outbound pass start location is the location for starting the outbound pass during reciprocating movement of the carriage 7. In the present embodiment, the outbound pass start location is located between the maintenance device 11 and the workpiece table 25 in the X direction. The outbound pass start location is located to the outside of the workpiece table 25 in plan view.

Next, in Step S2, the CPU 113 outputs a workpiece conveyance instruction to the motor control section 141 (FIG. 5). At this time, the motor control section 141 controls driving of the workpiece conveyor motor 123 to move the workpiece W to the printing area.

Next, in Step S3, the CPU 113 outputs a carriage scan instruction to the motor control section 141 (FIG. 5). At this time, the motor control section 141 controls driving of the carriage conveyor motor 121 to initiate reciprocating movement of the carriage 7.

During reciprocating movement of the carriage 7, the carriage 7 undergoes reciprocating movement between the aforementioned outbound pass start location and a return pass start location. Specifically, a path going from the outbound pass start location to a turnaround at the return pass start location and then back to the outbound pass start location constitutes one round trip of the carriage 7. Therefore, in the present embodiment, the path going from the outbound pass start location towards the return pass start location constitutes an outbound pass of the carriage 7. On the other hand, the path going from the return pass start location towards the outbound pass start location constitutes a return pass of the carriage 7.

The return pass start location is a location facing the outbound pass start location in the X direction with the workpiece table 25 (FIG. 1) therebetween. The return pass start location is located to the outside of the workpiece table 25 in plan view. Therefore, the outbound pass start location and the return pass start location face one another in the X direction, to either side of the workpiece table 25 in plan view.

Next, in Step S4, the CPU 113 outputs to the irradiation control section 147 (FIG. 5) an irradiation instruction for the irradiation device 15*a*. At this time, the irradiation control section 147 controls driving of the light source 43 of the irradiation device 15*a* and illuminates the light source 43 of the irradiation device 15*a*.

Next, in Step S5, the CPU 113 outputs an ejection instruction to the ejection control section 145 (FIG. 5). At this time, the ejection control section 145 controls driving of the ejection heads 33, and ejects droplets 55 from the nozzles 37 on the basis of the print data. Printing is thereby carried out during the outbound pass.

Next, in Step S6, the CPU 113 determines whether the position of the carriage 7 has reached the return pass start location. At this time, if determined that the position of the carriage 7 has reached the return pass start location (Yes), the process advances to Step S7. On the other hand, if determined that the position of the carriage 7 has not reached the return pass start location (No), the process waits until the position of the carriage 7 reaches the return pass start location.

In Step S7, the CPU 113 outputs to the irradiation control section 147 (FIG. 5) a stop instruction for the irradiation device 15*a*. At this time, the irradiation control section 147 controls driving of the light source 43 of the irradiation device 15*a* to extinguish the light source 43 of the irradiation device 15*a*.

Next, in Step S8, the CPU 113 outputs a carriage return instruction (linefeed instruction) to the motor control section 141 (FIG. 5). At this time, the motor control section 141 controls driving of the workpiece conveyor motor 123 to move the workpiece W in the Y direction (carriage return), and moves to a new area of the workpiece W as the print area for printing a pattern.

Next, in Step S9, the CPU 113 outputs to the irradiation control section 147 (FIG. 5) an irradiation instruction for the irradiation device 15*b*. At this time, the irradiation control section 147 controls driving of the light source 43 of the irradiation device 15*b* and illuminates the light source 43 of the irradiation device 15*b*.

Next, in Step S10, the CPU 113 outputs an ejection instruction to the ejection control section 145 (FIG. 5). At this time, the ejection control section 145 controls driving of the ejection heads 33, and ejects droplets 55 from the nozzles 37 on the basis of print data. Printing is thereby carried out during the return pass.

Next, in Step S11, the CPU 113 determines whether the position of the carriage 7 has reached the outbound pass start location. At this time, if determined that the position of the carriage 7 has reached the outbound pass start location (Yes), the process advances to Step S12. On the other hand, if determined that the position of the carriage 7 has not reached the outbound pass start location (No), the process waits until the position of the carriage 7 reaches the outbound pass start location.

In Step S12, the CPU 113 outputs to the irradiation control section 147 (FIG. 5) a stop instruction for the irradiation device 15*b*. At this time, the irradiation control section 147 controls driving of the light source 43 of the irradiation device 15*b* to extinguish the light source 43 of the irradiation device 15*b*.

Next, in Step S13, the CPU 113 determines whether the print data has been completed. At this time, if determined that the print data has been completed (Yes), the process terminates. On the other hand, if determined that the print data is not complete (No), the process advances to Step S14.

In Step S14, the CPU 113 outputs a carriage return instruction (linefeed instruction) to the motor control section 141 (FIG. 5), and advances the process to Step S4. At this time, the motor control section 141 controls driving of the workpiece conveyor motor 123 to move the workpiece W in the Y direction (carriage return), and moves to a new area of the workpiece W as the print area for printing a pattern.

EXAMPLES

The description now turns to the results of producing images with an image coating compound containing an acrylic resin, using the droplet ejection device 1 described above.

The recording method according to the present example is described here.

Figure 7:
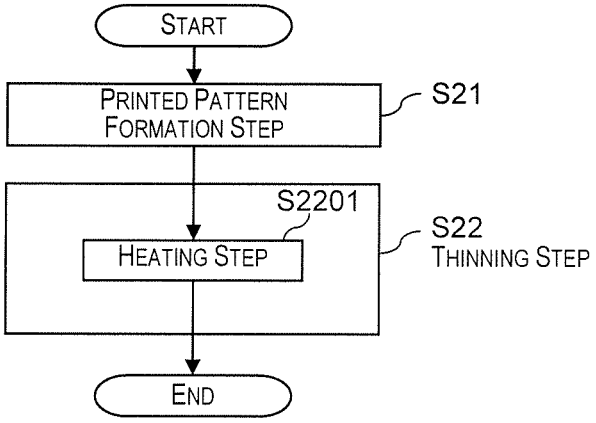
FIG. 7 is a diagram depicting the flow of the recording method in the embodiment.

As shown in FIG. 7, the recording method of the present example has a printed pattern formation step S21 and a thinning step S22.

In the printed pattern formation step S21, a pattern of an image (hereinafter termed a printed pattern) is formed on the workpiece W on the basis of the printing process (FIG. 6) described above.

Next, in the thinning step S22, the film that constitutes the printed pattern is reduced in thickness.

The thinning step S22 involves a heating step S2201. In the present example, there is employed a method of reducing film thickness through heating of the printed pattern. In the heating step S2201, the printed pattern is heated by placing the workpiece W on a hotplate. At this time, the temperature setting of the hot plate is 180° C. The heating time is 1 minute. In the heating step S2201, the workpiece W is arranged with the side thereof on the opposite side from the printed pattern resting on the hotplate.

Example 1

An electronic component (in the present embodiment, a semiconductor device) encapsulated in epoxy resin was prepared as a sample 1. A printed pattern was printed onto the sample 1, on the basis of the printing process described above (FIG. 6). In this example, the printed pattern was printed onto the resin encapsulating the electronic component (hereinafter termed the encapsulating resin).

In this example, during the step of irradiation with ultraviolet light 41 in the printing process (FIG. 6), the polymerization percentage of the resin making up the printed pattern was set to 70%. Here, the polymerization percentage represents the proportion of polymerized resin per unit volume of the printed pattern. The polymerization percentage was measured by the ATR (Attenuated Total Reflection) method using FT-IR (Fourier Transform Infrared Spectroscopy).

Next, the thickness of the film making up the printed pattern was measured. For film thickness measurement, a step height/surface roughness/microtopography measurement device (model P-15 manufactured by KLA-Tencor) was used as the measuring instrument.

Next, the sample 1 was placed on a hotplate, and the printed pattern was heated.

Next, the thickness of the film making up the printed pattern was measured. For film thickness measurement, the aforementioned step height/surface roughness/microtopography measurement device was used.

Example 2

An electronic component (in the present embodiment, a semiconductor device) encapsulated in epoxy resin was prepared as a sample 2. A printed pattern was printed onto the sample 2, on the basis of the printing process described above (FIG. 6). In this example, the printed pattern was printed onto the resin encapsulating the electronic component (hereinafter termed the encapsulating resin).

In this example, during the step of irradiation with ultraviolet light 41 in the printing process (FIG. 6), the polymerization percentage of the resin making up the printed pattern was set to 40%. The polymerization percentage was measured in accordance with the procedure of Example 1. Next, the thickness of the film making up the printed pattern was measured. The film thickness was in measured accordance with the procedure of Example 1.

Next, the sample 2 was placed on a hotplate, and the printed pattern was heated. Next, the thickness of the film making up the printed pattern was measured. The film thickness was in measured accordance with the procedure of Example 1.

Example 3

A silicon substrate was prepared as a sample 3. A printed pattern was printed onto the sample 3, on the basis of the printing process described above (FIG. 6).

In this example, during the step of irradiation with ultraviolet light 41 in the printing process (FIG. 6), the polymerization percentage of the resin making up the printed pattern was set to 70%. The polymerization percentage was measured in accordance with the procedure of Example 1.

Next, the thickness of the film making up the printed pattern was measured. The film thickness was in measured accordance with the procedure of Example 1.

Next, the sample 3 was placed on a hotplate, and the printed pattern was heated. Next, the thickness of the film making up the printed pattern was measured. The film thickness was in measured accordance with the procedure of Example 1.

Example 4

A silicon substrate was prepared as a sample 4. A printed pattern was printed onto the sample 4, on the basis of the printing process described above (FIG. 6).

In this example, during the step of irradiation with ultraviolet light 41 in the printing process (FIG. 6), the polymerization percentage of the resin making up the printed pattern was set to 40%. The polymerization percentage was measured in accordance with the procedure of Example 1.

Next, the thickness of the film making up the printed pattern was measured. The film thickness was in measured accordance with the procedure of Example 1.

Next, the sample 4 was placed on a hotplate, and the printed pattern was heated. Next, the thickness of the film making up the printed pattern was measured. The film thickness was in measured accordance with the procedure of Example 1.

Comparative Examples

Images were produced with an image coating compound containing an acrylic resin, using the droplet ejection device 1 described above. In the Comparative Examples, however, the thinning step S22 was omitted.

Comparative Example 1

An electronic component (in the present embodiment, a semiconductor device) encapsulated in epoxy resin was prepared as a sample 5. A printed pattern was printed onto the sample 5, on the basis of the printing process described above (FIG. 6). In this example, the printed pattern was printed onto the resin encapsulating the electronic component (hereinafter termed the encapsulating resin).

In this example, during the step of irradiation with ultraviolet light 41 in the printing process (FIG. 6), the polymerization percentage of the resin making up the printed pattern was set to 100%. The polymerization percentage was measured in accordance with the procedure of Example 1.

Comparative Example 2

A silicon substrate was prepared as a sample 6. A printed pattern was printed onto the sample 6, on the basis of the printing process described above (FIG. 6).

In this example, during the step of irradiation with ultraviolet light 41 in the printing process (FIG. 6), the polymerization percentage of the resin making up the printed pattern was set to 100%. The polymerization percentage was measured in accordance with the procedure of Example 1.

The samples 1 to 6 were subjected to a cleaning test involving immersion in a cleaning solution.

The samples 1 to 6 were immersed in a cleaning solution containing alcohol as the primary component. At this time, the temperature of the cleaning solution was set to 75° C. Immersion time in the cleaning solution was 10 minutes. Next, the samples 1 to 6 were immersed in a rinse agent. At this time, the temperature of the rinse agent was set to 20° C. Immersion time in the rinse agent was 30 minutes. An aqueous solution of alcohol was employed as the rinse agent.

Next, samples 1 to 6 were dried in a 110° C. temperature environment. The condition of the printed patterns was evaluated for the respective samples 1 to 6.

Evaluation results for Comparative Example 1, Example 1, and Example 2 are shown in Table 1 below.

TABLE 1

| | Evaluation result | Film thickness (μm) | |
|---|---|---|---|
| | | Before heating | After heating |
| Comparative Example 1 | X | — | — |
| Example 1 | ○ | 5.15 | 4.36 |
| Example 2 | ○ | 5.61 | 0.97 |

In the evaluation results shown in Table 1, "O" indicates that the printed pattern was in good condition, with no delamination of the printed pattern.

"X" indicates that delamination of the printed pattern occurred.

From the results in Table 1 it may be appreciated that, for the resin-encapsulated electronic components, it is preferable to set the polymerization percentage with irradiation with ultraviolet light 41 to 70% or less, and to then heat the printed pattern. Heating has the effect of reducing the thickness of the film. It will be appreciated that the volume of the printed pattern is reduced thereby. It is thought that heating brings about volatilization of the unpolymerized component in the printed pattern. As a result, the polymerization percentage of the printed pattern is higher as compared with that prior to heating. This is thought to be responsible for the good evaluation results obtained in the cleaning tests. Here, notwithstanding volatilization of the unpolymerized component in the printed pattern due to heat, the amount of pigment contained in the printed pattern is substantially unchanged before and after heating. That is, the same amount of pigment is readily maintained before and after heating. Therefore, there is substantially no loss of visibility of the printed pattern.

As the above results demonstrate, according to a recording method that includes a printed pattern formation step S21 and the thinning step S22, printed patterns can be made resistant to delamination from the workpiece W, and dependability of the printed patterns can be improved readily.

In this recording method, it is preferable to thin the film by heating the printed pattern. By so doing, the unpolymerized component in the printed pattern can be easily eliminated.

In this recording method, it is preferable to heating the printed pattern after having set the polymerization percentage with irradiation with ultraviolet light 41 to 70% or less. By so doing, dependability of the printed patterns in resin-encapsulated electronic components can be readily improved.

Evaluation results for Comparative Example 2, Example 3, and Example 4 are shown in Table 2 below.

TABLE 2

| | Evaluation result | Film thickness (μm) Before heating | After heating |
|---|---|---|---|
| Comparative Example 2 | X | — | — |
| Example 3 | X | 5.15 | 4.36 |
| Example 4 | ○ | 5.61 | 0.97 |

In the evaluation results shown in Table 2, "O" indicates that the printed pattern was in good condition, with no delamination of the printed pattern.

"X" indicates that delamination of the printed pattern occurred.

From the results in Table 2 it may be appreciated that, for the silicon substrates, it is preferable to set the polymerization percentage with irradiation with ultraviolet light 41 to 40% or less, and to then heat the printed pattern. These results also show that heating has the effect of reducing the thickness of the film. It will be appreciated that the volume of the printed pattern is reduced thereby. It is thought that heating brings about volatilization of the unpolymerized component in the printed pattern. As a result, the polymerization percentage of the printed pattern is higher as compared with that prior to heating. This is thought to be responsible for the good evaluation results obtained in the cleaning tests. Here, notwithstanding volatilization of the unpolymerized component in the printed pattern due to heat, the amount of pigment contained in the printed pattern is substantially unchanged before and after heating. That is, the same amount of pigment is readily maintained before and after heating. Therefore, there is substantially no loss of visibility of the printed pattern.

As the above results demonstrate, according to a recording method that includes a printed pattern formation step S21 and the thinning step S22, printed patterns can be made resistant to delamination from the workpiece W, and dependability of the printed patterns can be improved readily.

In this recording method, it is preferable to thin the film by heating the printed pattern. By so doing, the unpolymerized component in the printed pattern can be easily eliminated.

In this recording method, it is preferable to heating the printed pattern after having set the polymerization percentage with irradiation with ultraviolet light 41 to 40% or less. By so doing, dependability of the printed patterns on silicon substrates can be readily improved. Therefore, the dependability of the printed patterns in electronic components of bare chip type, for example, can be improved readily.

In the present embodiment, the workpiece W corresponds to the electronic component, the printed pattern corresponds to the recording pattern, and the printed pattern formation step S21 corresponds to the printing step and the photoirradiation step.

In the present embodiment, the inkjet method, which is one application method, is employed as the method for applying the liquid 45 in the printed pattern formation step S21. However, the application method is not limited to the inkjet method, and a dispensing method, an imprinting method, or the like could be used as well. However, use of the inkjet method is preferred, due to the ability to apply the liquid 45 in any desired amount at any location on the workpiece W.

In the present embodiment, as shown in FIG. 7, the recording method has two steps, namely, the printed pattern formation step S21 and the thinning step S22. However, the configuration of the recording method is not limited to this. As an alternative configuration for the recording method, there may be employed, for example, a configuration in which the thinning step S22 is followed by an additional main curing step.

For the main curing step, there may be employed, for example, a method of irradiating the film constituting the printed pattern with ultraviolet light, a method of heating the film constituting the printed pattern, or the like. Further, for the main curing step, there may be employed, for example, a method of irradiating the film constituting the printed pattern with ultraviolet light, a method of heating the film constituting the printed pattern, or the like.

Through addition of a main curing step, curing of the film constituting the printed pattern can be accelerated more readily. Therefore, the film constituting the printed pattern may readily be made even stronger. By so doing, the printed pattern may be made even more resistant to delamination from the workpiece W, and therefore further improvement of dependability of the printed pattern may be readily achieved. In this case, the main curing step corresponds to the curing step.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording method comprising:

printing a recording pattern onto an electronic component with a photocuring liquid having the property of accelerating curing when irradiated with light;

irradiating light onto liquid that constitutes the recording pattern after the printing of the recording pattern; and thinning a film that constitutes the recording pattern by heating the recording pattern after the irradiating of the light, in the irradiating of the light, polymerization of the liquid is kept at a rate of 70% or less.

2. A recording method comprising:

printing a recording pattern onto an electronic component with a photocuring liquid having the property of accelerating curing when irradiated with light;

irradiating light onto liquid that constitutes the recording pattern after the printing of the recording pattern; and thinning a film that constitutes the recording pattern by heating the recording pattern after the irradiating of the light, in the irradiating of the light, polymerization of the liquid is kept at a rate of 40% or less.

3. The recording method according to claim 1, wherein in the irradiating of the light, polymerization of the liquid is kept at a rate of 40% or less.

4. The recording method according to claim 1, wherein the liquid is ejected onto the electronic component by an inkjet method in the printing of the recording pattern, thereby printing the recording pattern onto the electronic component.

5. The recording method according to claim 1, further comprising accelerating curing of the film constituting the recording pattern after the thinning of the film.

6. The recording method according to claim 2, wherein the liquid is ejected onto the electronic component by an inkjet method in the printing of the recording pattern, thereby printing the recording pattern onto the electronic component.

7. The recording method according to claim 2, further comprising accelerating curing of the film constituting the recording pattern after the thinning of the film.

* * * * *